United States Patent [19]

Suematsu et al.

[11] Patent Number: 4,628,019

[45] Date of Patent: Dec. 9, 1986

[54] PROCESS FOR DEVELOPING ELECTROSTATIC IMAGES AND TONER THEREFOR

[75] Inventors: Koshi Suematsu, Kawasaki; Takeshi Ikeda, Yokohama; Atsuko Yamamoto, Komae; Koji Goto, Kawasakishi; Eiichi Imai, Narashino, all of Japan

[73] Assignee: Canon Kabushiki Kaisha, Tokyo, Japan

[21] Appl. No.: 724,546

[22] Filed: Apr. 18, 1985

[30] Foreign Application Priority Data

Apr. 27, 1984 [JP] Japan ..... 59-85318

[51] Int. Cl.[4] ..... G03G 9/08

[52] U.S. Cl. ..... 430/106.6; 430/109

[58] Field of Search ..... 430/109, 137, 124, 106.6

[56] References Cited

U.S. PATENT DOCUMENTS

| | | | |
|---|---|---|---|
| 4,386,147 | 5/1983 | Seimiya et al. | 430/109 |
| 4,514,486 | 4/1985 | Shirose et al. | 430/124 |
| 4,514,487 | 4/1985 | Kasuya et al. | 430/137 |

*Primary Examiner*—John L. Goodrow

*Attorney, Agent, or Firm*—Fitzpatrick, Cella, Harper & Scinto

[57] ABSTRACT

A substantially nonmagnetic toner comprising a colorant and a binder comprising a homopolymer or copolymer having a ratio (Mw/Mn) of a weight-average molecular weight (Mw) of a number average molecular weight (Mn) of less than 5.0 is formed in a thin layer on a toner carrying member. The layer of toner is carried to a developing zone at which an image bearing member is disposed to face the toner carrying member with a clearance larger than the toner layer thickness and an electrostatic image on the image bearing member is developed with the thin layer of toner. The toner binder resin preferably comprises a copolymer of a vinyl monomer and an amonoacrylic monomer.

16 Claims, 6 Drawing Figures

PROCESS FOR DEVELOPING ELECTROSTATIC IMAGES AND TONER THEREFOR

BACKGROUND OF THE INVENTION

This invention relates to a process for developing electrostatic images formed on an electrostatic image bearing surface, particularly to a process for developing electrostatic images by forming a thin and uniform toner layer of a specific toner which is insulating and substantially nonmagnetic on a toner carrying member and permitting the toner of the toner layer to jump onto the electrostatic image bearing surface, and to a toner therefor.

The developing methods of the prior art in electrophotography, electrostatic recording, etc., may be classified broadly into dry system developing methods and wet system developing methods. The former methods are further classified into methods employing two-component developer and methods employing one-component developer. Those belonging to the two-component developing methods include, depending on the carriers employed for delivering toner, the magnetic brush method employing iron powder, the cascade method employing a bead carrier, and the fur brush method employing fur.

Those belonging to the one-component developing methods include the powder cloud method in which toner particles are used in atomized state; the contact developing method (also called as toner developing method) in which toner particles are permitted to contact directly the electrostatic surface; the jumping developing method, in which toner particles are not permitted to contact directly the electrostatic image, but rather the charged toner particles are permitted to fly through the electrical field possessed by the electrostatic latent images toward said latent image surface; and the magne-dry method in which development is effected by permitting magnetic electroconductive toner to contact the electrostatic latent image surface.

In one-component developing methods, the magne-dry method employing a magnetic toner and the contact developing method employing a non magnetic toner involve a problem that the toner contacts all the surface to be developed, namely, both the image portion and the non-image portion indiscriminately, whereby the toner is readily attached even to the non-image portion to cause contamination as ground fog. With respect to fog contamination, a similar tendency is observed also in the two-component developing method. Also in the powder cloud method, attachment of the toner particles in powdery state onto the non-image portion cannot be avoided, thus having the same problem that the ground fog cannot be removed. The jumping developing method as disclosed in Japanese Laid-Open Patent Applications No. 43027/1979 and No. 18656/1980, comprising disposing an electrostatic image bearing member having an electrostatic image on the surface thereof and a toner carrying member at the developing zone with a clearance therebetween, causing a toner to be carried on the toner carrying member to a thickness less than the distance defined by the above clearance and transferring the toner to the above electrostatic image bearing member at the developing zone, has the advantage not inadvertently producing the fog as mentioned above, and therefore may be appreciated as an electrostatic image developing method providing images which are high in faithfulness and stable in image quality. This method can provide a developing method which is excellent in durability such as successive use characteristic, and stable under various environmental conditions such as high temperature and high humidity or low temperature and low humidity. However, as a problem in this method, the toner layer on the toner carrying member is required to be uniform, otherwise, there is a fear that density irregularity of image or ground fog may be generated to give an unsightly image.

We have investigated in this developing method by use of non-magnetic or weakly magnetic toners and consequently found that it is important to control precisely the quantity of static charge possessed by the toner in order to improve the problem as mentioned above in the jumping developing method.

Further, we have found that the charging characteristic of a toner concerned with the static charge quantity can be controlled by controlling the molecular weight distribution of the resin constituting the toner.

SUMMARY OF THE INVENTION

An object of the present invention is to provide an improved developing method by use of a toner which is substantially non-magnetic of a saturated magnetization of 10 emu/g or less under the external magnetic field of 5000 Oe and a toner therefor.

Another object of the present invention is to provide a developing process which provides images high in faithfulness and stable in image quality, and further to provide a developing process which can remove ground fog phenomenon to give an image of high resolution and uniform and sufficient in density at the image portion.

Still another object of the present invention is to provide a developing process as described above which is excellent in durability such as successive use characteristics, etc.

It is also another object of the present invention to provide a developing process which is stable under various environmental conditions including high temperature and high humidity conditions and low temperature and low humidity conditions.

Still another object of the present invention is to provide a developing process which can afford an image having a clear hue of multi-colors such as red and blue colors or monochromatic color.

More specifically, according to the present invention, there is provided a process for developing an electrostatic image, comprising:

defining a developing zone by disposing an electrostatic image bearing member having an electrostatic image on the surface thereof and a toner carrying member in opposed relationship and with a clearance therebetween;

providing a layer of a substantially non-magnetic toner on the surface of said toner carrying member having a thickness less than the distance defined by said clearance at the developing zone wherein said toner comprises a colorant and a binder resin comprising a homopolymer or copolymer having a ratio (Mw/Mn) of a weight average molecular weight (Mw) to a number average molecular weight (Mn) of less than 5.0; and electrically transferring said toner to said electrostatic image bearing member to develop said electrostatic image.

Further, according to another aspect of the present invention, there is provided a toner for development, comprising a colorant and a binder resin containing 20% by weight or more of a nitrogen-containing copolymer of a vinyl monomer and an aminoacrylic monomer of the formula:

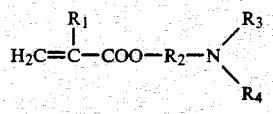

wherein $R_1$ is hydrogen, methyl or ethyl; $R_2$ is an alkylene having 1 to 4 carbon atoms; $R_2$ is an alkyl having 1 to 6 carbon atoms or phenyl; and $R_4$ is an alkyl having 1 to 6 carbon atoms or phenyl, said copolymer having a ratio of Mw/Mn of less than 5.0 wherein Mw represents a weight average molecular weight and Mn represents a number average molecular weight.

BRIEF DESCRIPTION OF THE DRAWINGS

In the accompanying drawings.

DETAILED DESCRIPTION OF THE INVENTION

Figure 1:
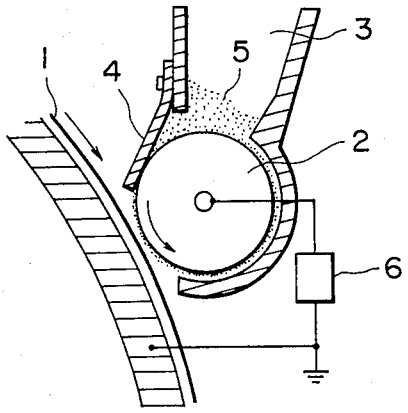
FIG. 1 to FIG. 5 are schematic sectional views of the developing devices for practicing the developing process of the present invention.

The resin to be used in the toner of the present invention has a Mw/Mn of 5 or less, preferably 3.5 or less, exhibiting good charge controllability. In general, there may be employed homopolymers of styrene and its derivative and copolymers thereof such as polystyrene, poly-p-chlorostyrene, polyvinyltoluene, styrene-p-chlorostyrene copolymer, styrene-vinyltoluene copolymer; copolyxers of styrene and acrylates such as styrene-methyl acrylate copolymer, styrene-ethyl acrylate copolymer, styrene-n-butyl acrylate; copolymers of styrene and methacrylates such as styrene-methyl methacrylate copolymer, styrene-ethyl methacrylate copolymer, styrene-n-butyl methacrylate; multi-component copolymers of styrene, acrylates and methacrylates, styrene-dialkylaminoalkyl methacrylate copolymers, styrene-dialkylaminoalkyl methacrylate copolymers, styrene-acrylate-dialkylaminoalkyl acrylate copolymers, styrene-acrylate-dialkylaminoalkyl methacrylate copolymers; copolymers of styrene and other vinyl monomers such as styrene-acrylonitrile copolymer, styrene-vinyl methyl ether copolymer, styrene-butadiene copolymer, styrene-vinyl methyl ketone copolymer, styrene-acrylonitrile-indene copolymer, styrene maleate copolymer; polymethyl methacrylate, polybutyl methacrylate, polyvinyl acetate, polyesters, polyamides, epoxy resins, polyvinyl butyral, polyacrylic acid, phenol resins, aliphatic or alicyclic hydrocarbon resins, petroleum resins, chlorinated paraffins, etc., either singly or as a mixture.

Preferably, the binder resin should contain 20% by weight or more, more preferably 30% by weight or more of a homopolymer or a copolymer (including terpolymer) having an Mw/Mn of 5.0 or less. More preferably, the binder resin comprises more than 20% by weight or more of a nitrogen-containing copolymer of a vinyl monomer and an aminoacrylic monomer of the formula:

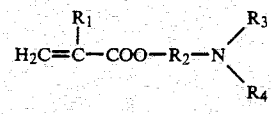

wherein $R_1$ is hydrogen, methyl or ethyl; $R_2$ is an alkylene having 1 to 4 carbon atoms; $R_3$ is an alkyl having 1 to 6 carbon atoms or phenyl; and $R_4$ is an alkyl having 1 to 6 carbon atoms or phenyl, and the copolymer has a ratio of Mw/Mn of less than 5.0 wherein Mw represents a weight average molecular weight and Mn represents a number average molecular weight.

More preferably, the binder resin comprises 20 to 90% by weight of a nitrogen-containing copolymer selected from the group consisting of styrene-dialkylaminoalkyl acrylate copolymers, styrene-dialkylaminoalkyl methacrylate copolymers, styrene-alkyl acrylatedialkylaminoalkyl acrylate copolymers, styrene-alkyl methacrylate-dialkylaminoalkyl acrylate copolymers, styrene-alkyl acrylate-dialkylaminoalkyl methacrylate copolymers and styrene-alkyl methacrylate-dialkylaminoalkyl methacrylate copolymers, and 10 to 80 % by weight of a polymer or copolymer selected from the group consisting of styrene polymers, styrene copolymers, polymethyl methacrylate, polybutyl methacrylate, polyvinyl acetate, polyesters, polyamides, epoxy resins, polyvinyl butyral, polyacrylic acids, phenolic resins, aliphatic or alicyclic hydrocarbon resins, petroleum resins, chlorinated paraffins, low molecular weight polyethylene, low molecular weight polypropylene, ethylene-vinyl acetate copolymer, ethylene-acrylate copolymer and higher fatty acids.

The weight ratio of the vinyl monomer and the aminoacrylic monomer in the nitrogen-containing copolymer should preferably be in the range of 98:2 to 85:15. The binder resin should preferably contain 0.4 to 13.5 wt. % of polymerized aminoacrylic monomer units.

As the binder resin for the toner to be provided for use in the pressure fixing system, it is possible to use such materials as low molecular weight polyethylene, low molecular weight polypropylene, ethylene-vinyl acetate copolymer, ethylene-acrylate copolymer, higher fatty acid, polyamide resins, polyester resins, either singly or in a mixture.

In the present invention, the values of Mw and Mn have been calculated from the values measured by gel permeation chromatography. Measurement was conducted at a temperature of 25° C. by permitting tetrahydrofuran as the solvent at a flow rate of 1 ml/min. and injecting 0.5 ml of a sample solution with a sample concentration of 8 mg/ml in tetrahydrofuran. As the column for gel permeation, it is preferable in order to precisely measure the molecular weight ragion of $10^3$ to $2\times10^6$ to combine a plurality of commercially available polystyrene gel columns, such as a combination of μ-Styragel 500, $10^3$, $10^4$ and 105 produced by Waters Co. or a combination of Shodex A-802, 803, 804 and 805 produced by Showa Denko K.K. In measurement of the molecular weight of a sample, the molecular weight distribution possessed by the sample has been calculated from the relationship between the logarithmic value in a calibration curve prepared from several kinds of monodispersed polystyrene standard samples and the count number. As the standard polystyrene samples for preparation of the calibration curve, for example, polystyrenes produced by Pressure Chemical Co. or Toyo Soda Kogyo K.K., having molecular weights of $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$ and $4.48\times10^6$ were employed. It is appropriate to use at least 10 standard polystyrene samples. The detector employed was an RI (refractive index) detector.

The nitrogen-containing polymer should preferably have an Mw of 5000 to 50,000 and an Mn of 1000 to 34,000, since such a polymer can give a toner excellent in charge controllability and sharp in triboelectric charge distribution.

The polymer and/or copolymer to be mixed should preferably have an Mw of 100,000 or more and an Mw/Mn ratio of 3.5 or more for improvement of fixing characteristic and off-set resistance of the toner.

For the toner, any desired suitable pigment or dye may be available as the colorant.

The colorant may include Carbon Black, Nigrosine dye, Lamp Black, Sudan Black SM, Fast Yellow G, Benzidine Yellow, Pigment Yellow, Indofast Orange, Irgazine Red, Paranitroaniline Red, Toluidine Red, Carmine FB, Permanent Bordeau FRR, Pigment Orange R, Risol Red 2G, Lake Red C, Rhodamine FB, Rhodamine B Lake, Methyl Violet B Lake, Phthalocyanine Blue, Pigment Blue, Brilliant Green B, Phthalocyanine Green, Oil Yellow GG, Zaponfast Yellow, Kayaset Y 963, Kayaset YG, Smiplast Yellow GG, Zaponfast Orange RR, Oil Scarlet, Smiplast Orange G, Orazol Brown B, Zaponfast Scarlet CG, Aizen Spilon Red, BEH, Oil Pink OP, etc.

It is also possible to add a free flowability improver such as silica or alumina.

A magnetic material may also be added auxiliarily in a small amount, provided that it will not adversely affect the present invention. As the magnetic material, there may be employed a material which can be magnetized when placed in a magnetic field, for example, powder of a ferromagnetic metal such as iron, cobalt or nickel, or alloys or compounds such as magnetite, hematite or ferrite.

The toner composition as described above may also be adopted in the wall material, the core material or both thereof of a microcapsule toner to prepare a microcapsule toner applicable for the present invention.

The charging characteristic of toner will be influenced by additives such as charge controlling agent, colorant or free flowability improver, but the charging characteristic of the resin which is the main component of a toner will have a fundamental effect on stabilization of the charging characteristic of the toner. In the present invention, the charging characteristic of the toner is improved by decreasing the Mw/Mn ratio of the binder resin. Since resins are generally colorless, no interference with color will occur even when the toner is colored with chromatic color. Further, in the positively chargeable toner, in the present invention, stabilization of the charging characteristic of the toner is effected by use of a copolymer of an aminoacrylic monomer and a vinyl monomer having an Mw/Mn ratio of 5 or less.

The present invention is now explained by referring to the accompanying drawings.

FIG. 1 shows an example of a developing device for practicing the process of the present invention in which an electrostatic latent image is developed by use of an insulating toner. In the developing device, an electrostatic latent image is formed on a cylindrical electrostatic image bearing member 1 according to a known electrophotographic method such as the Carlson method or the NP method, and the electrostatic latent image is developed with a toner 5 which has been applied by means of a coating means 4 for a specific toner 5 according to the present invention which is insulating and substantially non-magnetic in a hopper 3 as a toner supplying means on the toner carrying member 2 while regulating the layer thickness of the toner layer. The toner carrying member 2 is a developing roller made of a cylindrical stainless steel. As the material for the developing roller, aluminum or other metals may also be available. It is also possible to use a metal roller coated with a resin, etc., in order to triboelectrically charge the toner to a more desired polarity. Further, the developing roller may also be made of an electroconductive non-metallic material. The toner carrying member 2 has spacer rollers made of high density polyethylene at both ends of its shaft, although not shown in the figure. By fixing the developing instrument by permitting the spacer rollers to abut against both ends of the electrostatic image bearing member 1, the clearance between the electrostatic image bearing member 1 and the toner carrying member 2 is set and held wider than the thickness of the toner layer coated on the toner carrying member 2. The clearance may be, for example, 100 to 500μ, preferably 150 to 300μ. If the clearance is too wide, the electrostatic force given by the electrostatic latent image on the electrostatic image bearing member 1 and acting on the non-magnetic toner coated on the toner carrying member 2 will be weakened to lower the image quality, particularly making visualization of fine lines by development difficult. On the other hand, if the clearance is too narrow, the risk that the toner coated on the toner carrying member 2 may be compressed between the toner carrying member 2 and the electrostatic image bearing member to cause agglomeration is increased. A development bias power source 6 is disposed as to apply a voltage between the electroconductive toner carrying member 2 and the back electrode of the image bearing member 1. The development bias voltage is such a development bias voltage as described in Japanese Laid-Open Patent Application No. 18659/1980.

Figure 2:
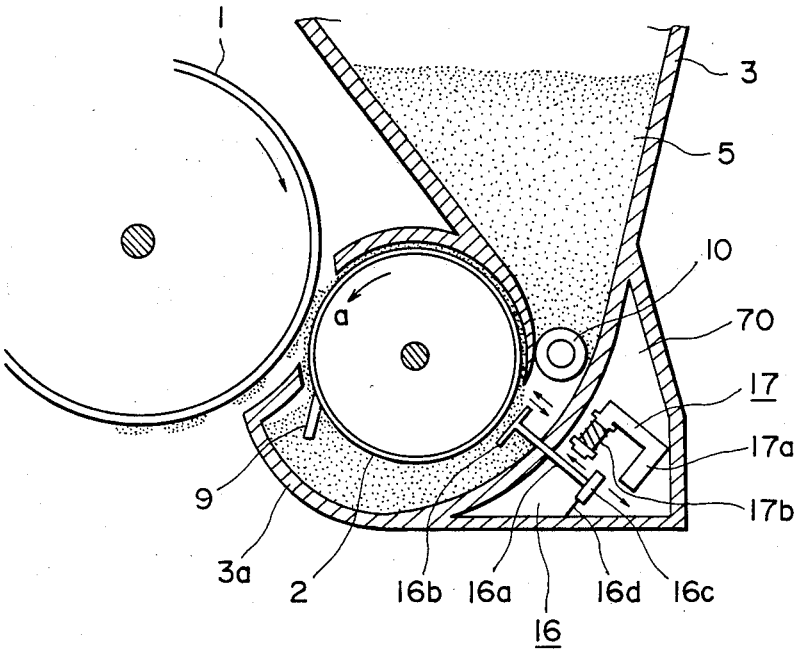

FIG. 2 shows another example of the device for practicing the process of the present invention. This device is provided with an electrostatic image bearing member 1, a toner carrying member 2, a specific toner 5 according to the present invention, a hopper 3, a cleaning blade 9, a toner feeding member 16, a vibration generating means 17, a permanent magnet 16, a supporting spring **16*b*, an iron core 17*a* and a coil 17*b*. By applying an alternating current to the coil 17*b* to vibrate the vibrating member 16 at an appropriate vibrating frequency, a uniformly coated toner layer is formed on the toner carrying member rotating at a constant speed, and the non-magnetic toner is permitted to jump onto the electrostatic image, while disposing the toner carrying member 2 and the electrostatic image bearing member opposed to each other with a clearance greater than the thickness of the toner coated layer at the developing zone, to develop the electrostatic image. Vibration of the vibrating member 16 may be exerted to any extent, provided that it will not directly contact the toner carrying member, but it is preferable to control the frequency and the amplitude of the vibration so that the thickness of the coated toner layer may be uniformly about 5 to 100μ. It is also preferred to apply an alternating or/and direct developing bias voltage between the toner carrying member 2 and the electrostatic image bearing member 1**.

Figure 3:
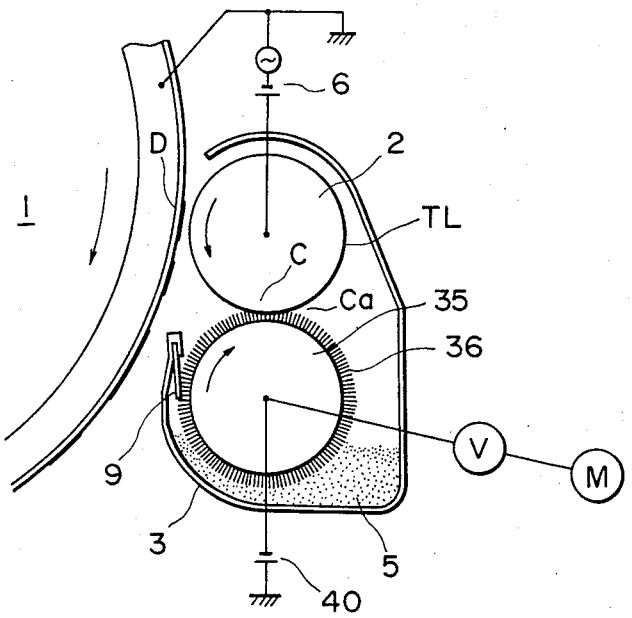

FIG. 3 shows another example of the developing device for practicing the present invention. This developing device is provided with an electrostatic image bearing member 1, a toner carrying member 2, a toner vessel 3, an insulating toner 5 as specified in the present invention, a developing bias power source 6, a toner cleaning member 9, a coating roller 35, a fiber brush 36 secured onto the surface of the roller and a bias power source 40. By rotating the coating roller 35, the toner 5 is delivered by the brush to be applied uniformly on the toner carrying member 2, and then permitted to jump onto the electrostatic image on the electrostatic image bearing member 1 to effect development. The clearance between the toner carrying member and the coating roller 35 is controlled so as to form a uniform toner layer with a thickness of about 5 to 100μ. During this operation, it is also possible to apply a bias voltage by the bias power source 40 for coating in order to effect uniform toner coating. The clearance between the electrostatic image bearing member 1 and the toner carrying member 2 may be made greater than the thickness of the above toner layer thickness at the developing zone, and a developing bias may also be applied by the developing bias power source 6 during development.

Figure 4:
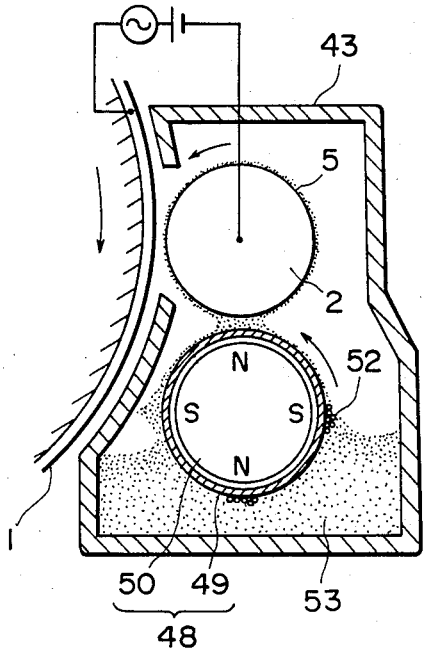

FIG. 4 shows still another example of the developing device for practicing the present invention. This developing device is provided with an electrostatic image bearing member 1, a toner carrying member 2, a toner 5 according to the present invention, a developing instrument 43, a magnetic roller 48, a non-magnetic sleeve 49, a magnet 50, a magnetic brush 52 and a one-component toner or a two-component developer 53 comprising a mixture of toner and magnetic particles. The magnetic particles are held by magnetic force on the non-magnetic sleeve 49 to form a magnetic brush, and the toner or the developer 53 is scooped or taken up by means of the above magnetic brush of magnetic particles and applied by contact on the toner carrying member 2 to form a uniform toner layer 5. Since the magnetic particles are held on the magnetic roller 48 through magnetic force, they will not be transferred onto the toner carrying member 2. Next, developing is effected by permitting the toner or developer to jump onto electrostatic image bearing member 1. The clearance between the magnetic roller 48 and the toner carrying member 2 is controlled so that the toner layer thickness on the toner carrying member 2 may be about 5 to 100μ. The clearance between the toner carrying member 2 and the electrostatic image bearing member is controlled to be greater than the toner layer thickness at the developing zone, and it is also possible to apply a developing bias to the toner carrying member 2.

Figure 5:
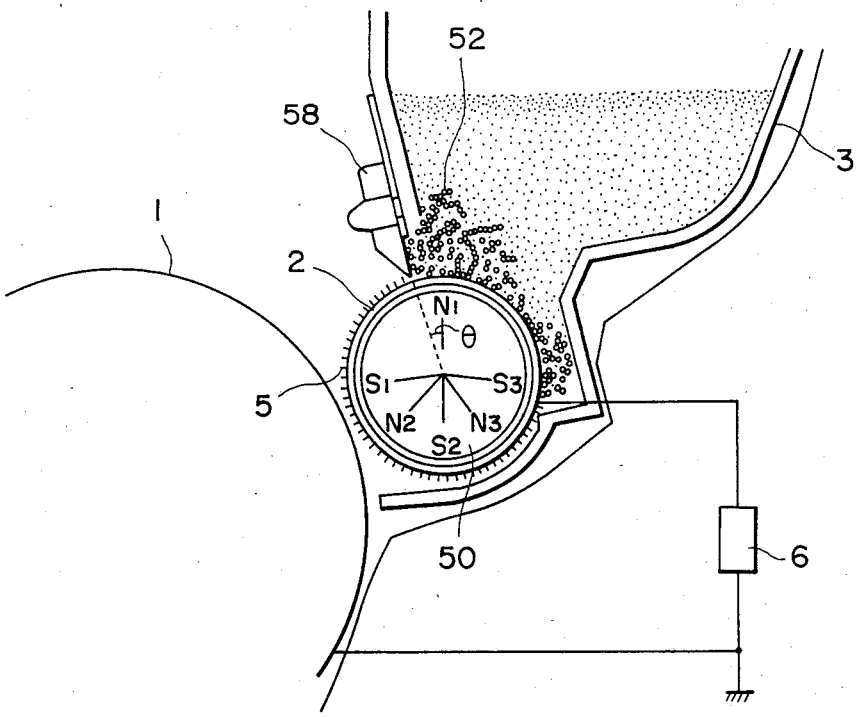

FIG. 5 shows still another example of the device for practicing the present invention. This device is provided with an electrostatic image bearing member 1, a toner carrying member 2, a hopper 3, a bias power source 6 for development, a specific toner 5 according to the present invention, a fixed magnet 50, a magnetic brush formed by a mixture comprising magnetic particles and the toner, and a blade 58 for regulating the toner thickness. The magnetic brush 52 formed on the toner carrying member 2 is circulated by rotating the toner carrying member 2, thereby taking up the toner in the hopper 3 into the brush, and the toner is applied as a thin layer coating uniformly on the toner carrying member. Next, the toner carrying member 2 and the electrostatic image bearing member 1 are disposed opposedly with a clearance greater than the toner layer thickness at the developing zone where both members approach closest to each other, thereby permitting the one component toner 5 on the toner carrying member 2 to jump onto the electrostatic image on the electrostatic image bearing member 1. The thickness of the toner layer is controlled by the size of the magnetic brush 52, namely the carrier amount and the regulating blade 58. The clearance between the electrostatic image bearing member 1 and the toner carrying member 2 may be made greater than the toner layer thickness, and it is also possible to apply a developing bias from the bias power source 6.

The present invention is described in detail by referring to the Examples practiced by use of the devices as described and Comparative Examples practiced according to the methods of the prior art. However, the present invention is not limited at all by the following Examples.

EXAMPLE 1

| | |
|---|---|
| Styrene-diethylaminoethyl methacrylate copolymer (Copolymerization weight ratio: 90:10, Mw = 18500, Mn = 5800, Mw/Mn = 3.2) | 30 parts |
| Styrene-butyl methacrylate copolymer (Copolymerization ratio: 85:15, Mw = 10000, Mw/Mn = 15.3) | 70 parts |
| Phthalocyanine pigment | 5 parts |

A mixture comprising the above components was kneaded, pulverized and classified to prepare a non-magnetic toner with a mean particle size of 10μ. The toner was thrown into the device as shown in FIG. 2 and, while vibrating the vibrating member 16 at a frequency of about 50 Hz with a magnitude of 0.2 mm, the toner carrying member was rotated at a circumferential speed of 120 mm/sec., whereby a uniformly coated toner layer with a thickness of about 50μwas formed. Then, by disposing the toner carrying member 2 and the electrostatic image bearing member opposed to each other, while maintaining a clearance of about 300μ, developing was carried out by applying a bias alternating current field to the toner carrying member 2 at a frequency of 100 to several KHz, a minus peak value of −660 to −1200 V and a plus peak value of +400 to +800 V.

The transferred image obtained was sufficiently high in density without fog or toner scattering around the image, and the image was good with high resolution. When durability in successive copying was examined by use of the above toner, the image obtained after copying 10,000 sheets was found to be comparable to the images at the initial stage. Also, when the environmental conditions were changed to 35° C. and relative humidity of 85%, the image density was not substantially changed from that under the conditions of normal temperature and normal humidity, without fog or scattering, to give clear red image. Durability was also substantially unchanged up to 10,000 sheets of successive copying. Transferred images were also obtained under the low temperature and low humidity conditions of 10° C. and relative humidity of 10%. As the result, the image density was high, with the solid black portion being also developed and transferred very smoothly to give excellent images without scattering or drop-off. When continuous and intermittent copying were carried out under these environmental conditions, the results obtained were also practically satisfactory, with the density change being ±0.2 up to 10,000 sheets of copying.

EXAMPLE 2

The same toner as used in Example 1 was thrown into the developing device as shown in FIG. 3, with the clearance between the toner carrying member 2 and the coating roller 35 being set at about 2 mm and the length of the fiber brush 36 at about 3 mm, and a toner layer of about 80μ in thickness was formed on the developing roller while maintaining the clearance between the developing roller and the electrostatic image bearing member at 200μ, followed by development with application of a bias voltage with peak values of −700 V and +200 V by adding a direct current of 250 V to the alternate current form with a frequency of 200 Hz and peak values of voltage of ±450 V. As the result, good results were obtained similarly as in Example 1.

EXAMPLE 3

The toner of Example 1 (20 g) was mixed previously with 20 g of iron powder particles (mean particle size: 60μ), and the mixture was thrown into the developing apparatus as shown in FIG. 5, in which the clearance between the regulating blade 58 and the toner carrying member is set at about 250μ, and a toner layer of about 80μ in thickness was formed on the developing roller while maintaining the clearance between the developing roller and the electrostatic image bearing member at 200μ, followed by development with application of a bias voltage with peak values of −700 V and +200 V by adding a direct current of 250 V to the alternate current form with a frequency of 200 Hz and peak values of voltage of ±450 V. As the result, good results similar to those of Example 1 were obtained.

EXAMPLE 4

| | |
|---|---|
| Styrene-diethylaminoethyl methacrylate-2-ethylhexyl acrylate (Copolymerization ratio: 86:13:1, Mw = 16000, Mn = 3500, Mw/Mn = 4.6) | 50 parts |
| Styrene-butadiene copolymer (Copolymerization ratio: 85:15, Mw = 110000, Mn = 10500, Mw/Mn = 10.5) | 50 parts |
| Phthalocyanine pigment | 5 parts |

A mixture comprising the above components was kneaded, pulverized and classified to prepare a toner with a mean particle size of 10μ. The toner obtained (20 g) was mixed previously with iron powder particles with a mean particle size of 80μ, and the resultant mixture was thrown into the developing machine as employed in Example 3, and development was carried out following the same procedure as in Example 3. As the result, good results were obtained similarly as in Example 1.

EXAMPLE 5

| | |
|---|---|
| Styrene-dimethylaminoethyl acrylate-n-butyl methacrylate (Copolymerization ratio: 80:3:17, Mw = 26000; Mn = 9300, Mw/Mn = 2.8) | 75 parts |
| Polystyrene (Mw = 200000; Mn = 28000, Mw/Mn = 7.1) | 25 parts |
| | 25 parts |

-continued

| | |
|---|---|
| Rhodamine red pigment | 5 parts |

A mixture comprising the above components was kneaded, pulverized and classified to prepare a toner with a mean particle size of 10μ. Latent images were developed in the same manner as in Example 3 to give good results.

EXAMPLE 6

| | |
|---|---|
| Styrene-butyl acrylate-dimethylaminoethyl methacrylate copolymer (Copolymerization ratio: 80:15:5, Mw = 20600, Mn = 9800, Mw/Mn = 2.1) | 100 parts |
| Rhodamine red pigment | 5 parts |

A non-magnetic toner with a mean particle size of 10μ comprising the above components was prepared. The toner was placed in the developing device as shown in FIG. 1, and development was carried out by means of a copying machine PC-10, produced by Canon K. K. In this case, the toner carrying member 2 used was a cylindrical sleeve made of stainless steel with an outer diameter of 50 mm, with the distance between the above photosensitive drum surface and the sleeve surface being set at 0.25 mm, and an alternating current bias of 400 Hz, 1000 V and a direct current bias of −150 V were applied to the sleeve.

The transferred image obtained was a good image sufficiently high in density with no fog at all and no scattering of the toner around the image, and also high in resolution.

EXAMPLE 7

| | |
|---|---|
| Polyester resin (Mw = 32000, Mn = 8000, Mw = 32000, Mn = 8000, Mw/Mn = 4.0) | 100 parts |
| Butylsalicylic acid chromium complex | 2 parts |

A non-magnetic toner with a mean particle size of 10μ comprising the above components was prepared. The toner was thrown into the developing device as shown in FIG. 4, in which the clearance between the toner carrying member 2 and the magnetic roller 48 was set at about 2 mm and the maximum thickness of the magnetic brush 52 at about 3 mm, and a toner layer of about 30μ in thickness was formed on the developing roller while maintaining clearance between the developing roller and the electrostatic image bearing member at 300μ, followed by development by means of a copying machine NP-270 produced by Canon K. K. with application of a bias voltage with peak values of +700 V and −200 V by adding a direct current of 250 V to the alternating current form with a frequency of 200 Hz and peak values of voltage of ±450 V. As the result, similarly good results were obtained.

COMPARATIVE EXAMPLE 1

Example 1 was repeated except that a styrenebutyl acrylate-dimethylaminoethyl methacrylate copolymer (Copolymerization ratio: 80:15:5, Mw=19500, Mn=3500, Mw/Mn=5.6) was employed. As the result, only images with very much ground fog could be obtained, and image density was remarkably lowered under high temperature and high humidity conditions.

COMPARATIVE EXAMPLE 2

| | |
|---|---|
| Styrene-dimethylaminoethyl acrylate-n-butyl methacrylate (Copolymerization ratio: 80:3:17, Mw = 58600, Mn = 9300, Mw/Mn = 6.3) | 15 parts |
| Polystyrene (Mw = 200000, Mn = 28000, Mw/Mn = 7.1) | 85 parts |
| Phthalocyanine pigment | 5 parts |

A mixture comprising the above components was kneaded, pulverized and classified to prepare a toner with a mean particle size of 10μ. When latent images were developed similarly as in Example 1, only images with much fog could be obtained.

EXPERIMENTAL EXAMPLE

Triboelectric charging characteristics of the aminoacrylic and polyester resins employed in the respective Examples and Comparative Examples were measured according to the following method.

The respective resins were pulverized and classified to particle sizes which might be deemed to be substantially of the same particle size distribution. The particle size distribution was such that the number average size was 9 to 11μ as measured by Coulter counter and the volume average size was 13 to 15μ with the number distribution of 6.35μ or less being 20% or less and the volume distribution of 20.2μ or more being 15% or less.

For imparting charge, iron powder or ferrite powder between 100–200 mesh was mixed with resin particles at a ratio of resin powder/iron powder of 5/95 and 20/80 in a ball mill for 30 seconds.

Figure 6:
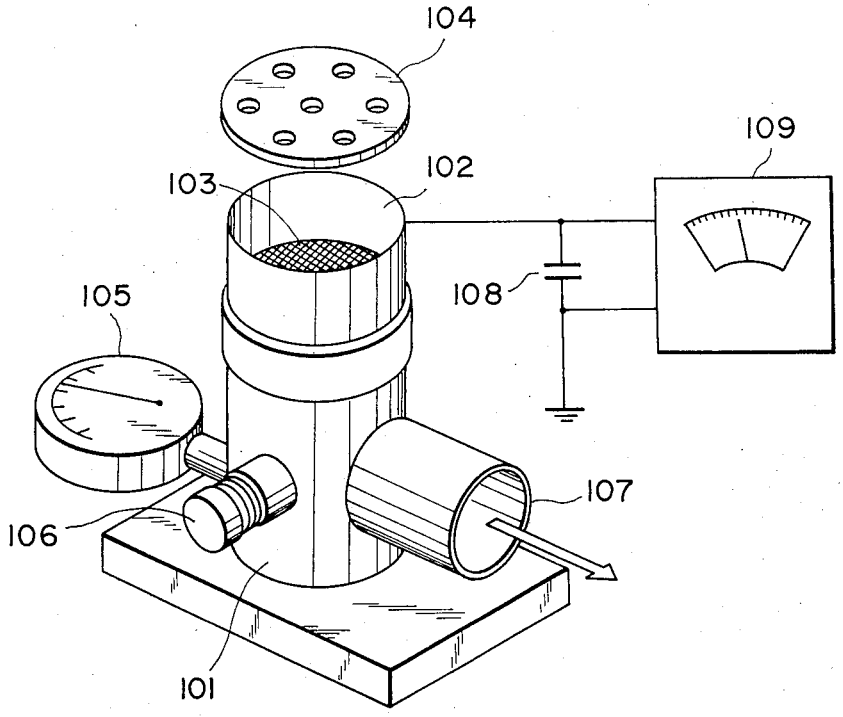
FIG. 6 is a schematic illustration of an example of the device for measuring the triboelectric charges of the binder resin to be used in the toner of the present invention.

For measurement of triboelectric charges, the device as shown in FIG. 6 was employed.

In a measuring vessel 102 made of a metal equipped at the bottom with a screen 103 of 400 mesh is placed 4 g of a mixture of the above resin, of which triboelectric charges were to be determined and the iron powder or ferrite powder, followed by closing of a lid 104 made of a metal. The whole weight of the measuring vessel 102 was weighed at this point and defined as $W_1$ (g). Next, in the aspirator 101 (made of an insulating material at least at the portion in contact with the measuring device 2), aspiration was performed through the aspirating outlet 107 to control the pressure of the vacuum indicator 105 at 70 mmHg by adjusting the air amount-controlling valve 106. Under this state, sufficient aspiration (for about 1 minute) was performed to remove the toner by aspiration. The potential reading by the potentiometer at this point is defined as V (volt). Here, the capacitance of a capacitor 108 was defined as C (μF). The weight of the whole measuring vessel after aspiration was weighed and defined as $W_2$ (g). The triboelectric charges (μc/g) of the binder resin were calculated as follows:

$$\text{Triboelectric charges of toner } T\ (\mu c/g) = \frac{C \times V}{W_1 - W_2}$$

The results of measurement are shown in the following Table:

TABLE

| | Polymer | Triboelectric charge of resin (=c/g) resin/iron powder 5/95 | 20/80 | Fluctuation (%) | resin/ferrite powder 5/95 | 20/80 | Fluctuation* (%) |
|---|---|---|---|---|---|---|---|
| Example 1 | Styrene-diethylaminoethyl methacrylate copolymer (Mw/Mn = 3.2) | +56.3 | +50.1 | 11.0 | +49.7 | +46.5 | 6.4 |
| Example 4 | Styrene-diethylaminoethyl methacrylate-2-ethyl-hexyl acrylate copolymer (Mw/Mn = 4.6) | +35.7 | +28.3 | 20.7 | +33.1 | +24.1 | 27.2 |
| Example 5 | Styrene-dimethylamino-ethyl acrylate-n-butyl methacrylate copolymer (Mw/Mn = 2.8) | +36.8 | +32.0 | 13.0 | +31.1 | +28.5 | 8.4 |
| Example 6 | Styrene-butylacrylate-dimethylaminoethyl methacrylate copolymer (Mw/Mn = 2.1) | +45.6 | +41.2 | 9.6 | +40.8 | +38.6 | 5.4 |
| Example 7 | Polyester resin (Mw/Mn = 4.0) | −18.5 | −12.5 | 32.4 | −16.6 | −10.7 | 35.5 |
| Comparative Example 1 | Styrene-butylacrylate-dimethyl aminoethyl methacrylate copolymer (Mw/Mn = 6.3) | +36.3 | +18.2 | 49.9 | +20.3 | +11.1 | 45.3 |

*Note:

$$\text{Fluctuation (\%)} = \frac{\left(\begin{array}{c}\text{triboelectric charge}\\ \text{at a ratio of 5/95 } (\mu c/g)\end{array}\right) - \left(\begin{array}{c}\text{triboelectric charge at}\\ \text{a ratio of 20/80 } (\mu c/g)\end{array}\right)}{\text{triboelectric charge at a ratio of 5/95 } (\mu clg)} \times 100$$

In view of the results in the preceding table, the following observation may be made. The resin having an Mw/Mn of less than 5.0 according to the present invention gives a smaller fluctuation in triboelectric charge compared with that of the resin having an Mw/Mn of more than 5.0 and is excellent in triboelectric charging characteristic. Particularly, the aminoacrylic resins having an Mw/Mn of less than 3.5 used in Examples 1, 5 and 6 give a still smaller fluctuation in triboelectric charge. On the other hand, the resin having an Mw/Mn of more than 5.0 has a larger fluctuation in triboelectric charge and is estimated to lack in stable triboelectric charging characteristic.

What is claimed is:

1. A process for developing an electrostatic image, comprising:

defining a developing zone by disposing an electrostatic image bearing member having an electrostatic image on a surface thereof and a toner carrying member in an opposed relationship with a clearance therebetween;

providing a layer of a substantially non-magnetic toner on a surface of said toner carrying member, said toner layer having a thickness less than the distance defined by said clearance at the developing zone, wherein said toner comprises a colorant and a binder resin comprising a nitrogen-containing copolymer having a ratio (Mw/Mn) of weight average molecular weight (Mw) to number average molecular weight (Mn) which is less than 3.5, said nitrogen-containing copolymer being a copolymer of a vinyl monomer and an aminoacrylic monomer of the formula:

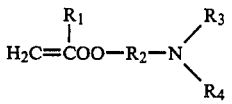

wherein $R_1$ is hydrogen, methyl or ethyl, $R_2$ is an alkylene having 1 to 4 carbon atoms, $R_3$ is an alkyl having 1 to 6 carbon atoms or phenyl and $R_4$ is an alkyl having 1 to 6 carbon atoms or phenyl; and electrically transferring said toner to said electrostatic image bearing member by causing said toner to jump onto said electrostatic image bearing member, thereby developing said electrostatic image.

2. A process according to claim 1, wherein the binder comprises more than 20% by weight of the nitrogen-containing copolymer.

3. A process according to claim 2, wherein the nitrogen-containing copolymer is a copolymer of styrene and the aminoacrylic monomer.

4. a process according to claim 3, wherein the binder resin comprises from 20 to 90% by weight of a nitrogen-containing copolymer selected from the group consisting of styrene-dialkylaminoalkyl acrylate copolymers, styrene-dialkylaminoalkyl methacrylate copolymers, styrene-alkyl acrylate-dialkylaminoalkyl acrylate copolymers, styrene-alkyl methacrylate-dialkylaminoalkyl acrylate copolymers, styrene-alkyl acrylate-dialkylaminoalkyl methacrylate copolymers and styrene-alkyl methacrylate-dialkylaminoalkyl methacrylate copolymers; and from 10 to 80% weight of a polymer or copolymer selected from the group consisting of styrene polymers, styrene copolymers, polymethyl methacrylate, polybutyl methacrylate, polyvinyl acetate, polyesters, polyamides, epoxy resins, polyvinyl butyral, polyacrylic acid, phenolic resins, aliphatic or alicyclic hydrocarbon resins, petroleum resins, chlorinated paraffins, low molecular weight polyethylene, low molecular weight polypropylene, ethylene-vinyl acetate copolymers, ethylene-acrylate copolymers and higher fatty acids.

5. A process according to claim 1, wherein the toner is transferred to the electrostatic image bearing member to develop the electrostatic image, while an altering current bias and a direct current bias are applied between the electrostatic image bearing member and the toner carrying member.

6. A process according to claim 1, wherein the toner is mixed with magnetic particles.

7. A process according to claim 1, wherein the toner layer at the developing zone has a thickness of 5 to 100μ.

8. A process according to claim 1, wherein the toner is a positively chargeable toner.

9. A toner for development, comprising a colorant and a binder resin containing 20% by weight or more of a nitrogen-containing copolymer of a vinyl monomer and an aminoacrylic monomer of the formula:

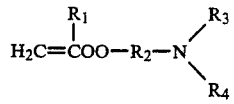

where $R_1$ is hydrogen, metyl or ethyl, $R_2$ is an alkylene having 1 to 4 carbon atoms, $R_3$ is an alkylene having 1 to 6 carbon atoms or phenyl, and $R_4$ is an alkyl having 1 to 6 carbon atoms or phenyl;

said copolymer having a ratio Mw/Mn of less than 3.5 wherein Mw represents a weight average molecular weight and Mn represents a number average molecular weight.

10. A toner according to claim 9, wherein the nitrogen-containing copolymer an Mw of 5,000 to 50,000 and an Mn of 1,000 to 34,000.

11. A toner according to claim 9, wherein the nitrogen-containing copolymer has a weight ratio of vinyl monomer: aminoacrylic monomer of 98:2 to 85:15.

12. A toner according to claim 11, wherein the nitrogen-containing copolymer is a copolymer of styrene and the aminoacrylic monomer.

13. A toner according to claim 9, wherein the binder resin comprises 20 to 90% by weight of a nitrogen-containing copolymer selected from the group consisting of styrene-dialkylaminoalkyl acrylate copolymers, styrene-dialkylaminoalkyl methacrylatecopolymers, styrene-alkyl acrylate-dialkylaminoalkyl acrylate copolymers, styrene-alkyl methacrylate-dialkylaminoalkyl acrylate copolymers, styrene-alkyl acrylate-dialkylaminoalkyl methacrylate copolymers and styrene-alkyl methacrylate-dialkylaminoalkyl methacrylate copolmers; and 10 to 80% by weight of a polymer or copolymer selected from the group consisting of styrene polymers, styrene copolymers, polymethyl methacrylate, polybutyl methacrylate, polyvinyl acetate, polyesters, polyamides, epoxy resins, polyvinyl butyral, polyacrylic acid, phenolic resins, aliphatic or alicyclic hydrocarbon resins, petroleum resins, chlorinated paraffins, low molecular weight polyethylene, low molecular weight polypropylene, ethylene-vinyl acetate copolymer, ethylene-acrylate copolymers and higher fatty acids.

14. A toner according to claim 13, wherein the binder resin contains a styrene polymer or copolymer having an Mw more than 100,000 and a ratio of Mw/Mn more than 3.5.

15. A toner according to claim 9, which is a substantially non-magnetic toner having a saturated mangetization of 10 emu/g or less under an external magnetic field of 5000 Oe.

16. A toner according to claim 9, which is a positively chargeable toner.

* * * * *